US005232015A

United States Patent [19]

Heffner et al.

[11] Patent Number: 5,232,015

[45] Date of Patent: Aug. 3, 1993

[54] EXPANSION VALVE WITH INLET STRAINER

[75] Inventors: Joseph H. Heffner, Chesterfield; Dennis L. Hoehne, St. Louis, both of Mo.

[73] Assignee: Sporlan Valve Company, St. Louis, Mo.

[21] Appl. No.: 963,271

[22] Filed: Oct. 19, 1992

Related U.S. Application Data

[63] Continuation of Ser. No. 782,065, Oct. 24, 1991, abandoned.

[51] Int. Cl.[5] ..... E03B 3/18

[52] U.S. Cl. ..... 137/549; 137/544

[58] Field of Search ..... 137/549, 544

[56] References Cited

U.S. PATENT DOCUMENTS 973,042 10/1910 Hicks ..... 137/549
3,115,154 12/1963 Dillon ..... 137/549
4,832,077 5/1989 Pilolla ..... 137/549

FOREIGN PATENT DOCUMENTS 1238487 4/1967 Fed. Rep. of Germany ..... 137/549

OTHER PUBLICATIONS

Bulletin 10-10, Sporlan Valve Company dated Oct. 1981 Thermostatic Expansion Valves with selective charges, p. 35.

*Primary Examiner*—A. Michael Chambers
*Attorney, Agent, or Firm*—Cohn, Powell & Hind

[57] ABSTRACT

This inlet strainer (160) is for a thermostatic expansion valve (100) having an inlet fitting (114). The inlet fitting 114 includes an elongate passage (152), with an inlet opening at one end and a strainer-receiving opening at the other end, and a transverse passage (156) communicating with the elongate passage (152) between said ends. The strainer assembly (160) includes a closed outer end (162) threadedly connected to the fitting (114), a strainer tube (164) extending into the elongate passage (152) to a point beyond the transverse passage (156) and a closure ring (166) received in sliding relation within the passage (152) so that dirt is removed from the refrigerant before entering the valve port.

3 Claims, 1 Drawing Sheet

FIG. 1.
(PRIOR ART)
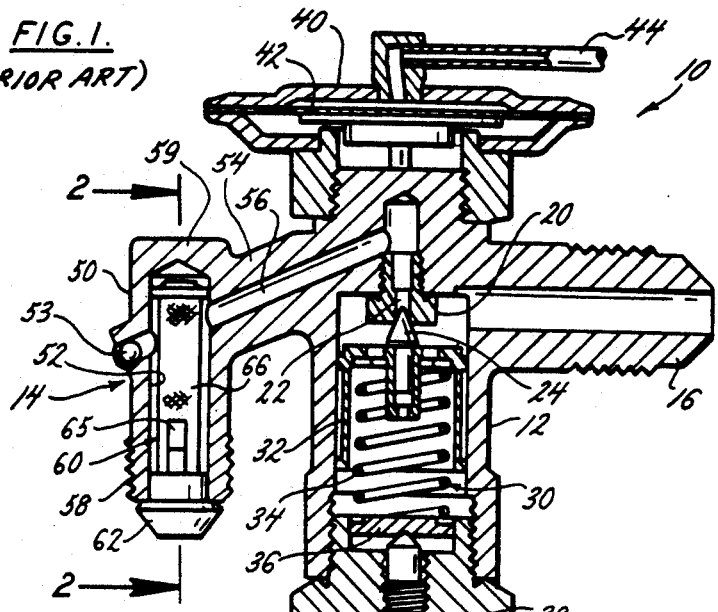
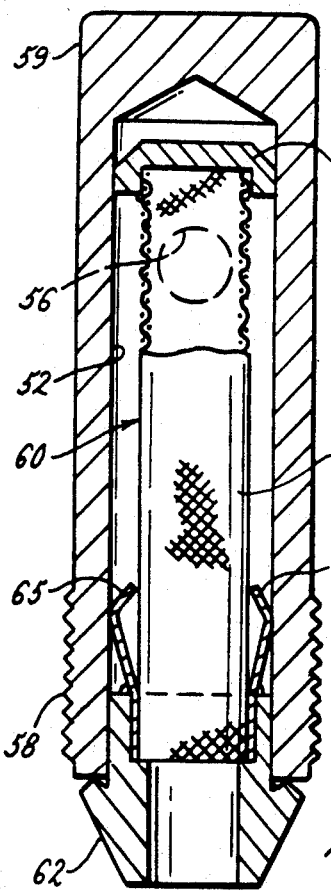
FIG. 2.
(PRIOR ART)
FIG. 3.
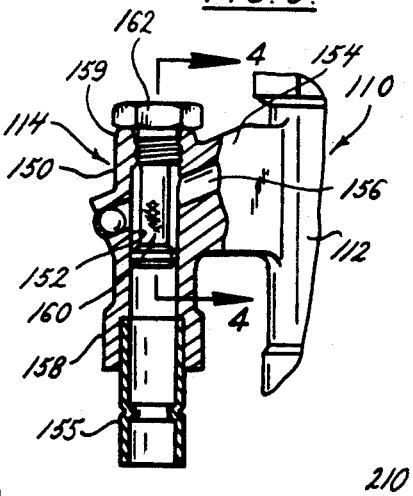
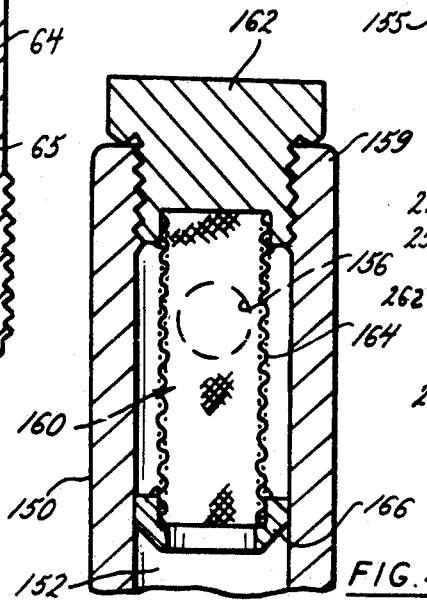
FIG. 4.
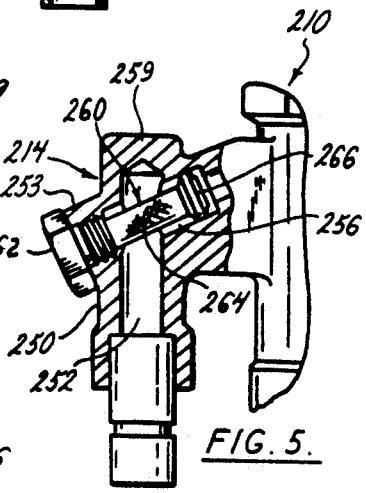
FIG. 5.

EXPANSION VALVE WITH INLET STRAINER

This is a continuation of copending application Ser. No. 07/782,065 filed on Oct. 24, 1991, now abandoned.

BACKGROUND OF THE INVENTION

This invention relates generally to expansion valves for refrigeration systems and particularly to an expansion valve having an improved strainer system at the inlet of the valve.

Concern about ozone depletion has led to the replacement of refrigerants formerly commonly used in commercial refrigeration systems, such as in supermarkets. These refrigerants are therefore being replaced with other refrigerants such as R-22. This refrigerant has a relatively high enthalphy and therefore uses a smaller port sizing for the thermostatic valves. Accordingly, the valves are much more susceptible to dirt collection which is a problem.

Another problem with refrigeration systems which affects the ozone layer is external leakage at the valve connections. In order to cut down leakage problems soldered joints are being used in lieu of flared joints. With flared joints, a strainer assembly placed in the inlet fitting of an expansion valve can be removed and cleaned comparatively easily. Removal and replacement are considerably more difficult to accomplish with soldered joints which must be unsoldered and resoldered, a task frequently made more difficult because of poor access.

These disadvantages are overcome with the present expansion valve strainer system in a manner not revealed in the known prior art.

SUMMARY OF THE INVENTION

This expansion valve inlet strainer assembly is effective to prevent dirt collection in valves ports and in particular in smaller valve ports. It can be removed and replaced without disturbing the connection of the refrigeration lines to the valve, even in those instances in which the lines have soldered connections.

The strainer assembly is intended for use with an expansion valve having an inlet means receiving refrigerant from a refrigeration system, an outlet means returning refrigerant to the system and an expansion valve means disposed between said inlet and outlet.

It is an aspect of the invention to provide that the valve inlet means includes first and second communicating passage portions, the first passage portion having a refrigerant-receiving inlet opening and the second passage portion being transversely disposed to the first passage portion and communicating with the valve means, one of said passage portions having a strainer-receiving opening spaced from said inlet opening and aligned with said one passage portion, and to provide a strainer means including a closed end and an open end and a strainer tube disposed between said ends, said closed end being removably connected to said inlet means at said strainer-receiving opening of said one passage portion and said strainer tube being received within said one passage portion and extending across said other passage portion whereby refrigerant is received into said tube and strained prior to entering said other passage portion.

It is an aspect of this invention that the first passage portion is generally vertical and the strainer-receiving opening is in said first passage portion.

In another aspect of this invention the second passage portion is inclined and the strainer-receiving opening is in said second passage portion.

Another aspect of this invention is that the strainer means includes a closure ring having a diameter to be received within the passage portion in sliding yet substantially sealing relation.

Still another aspect of this invention is to provide that said strainer-receiving passage portion is threaded at the strainer-receiving opening, and the strainer means closed outer end includes a threaded stud received by said threaded passage portion.

In another aspect of the invention the stud is recessed to receive the strainer tube.

In still another aspect of the invention the inlet means passage is adapted to connect to a refrigeration line in soldered relation at said one end of said passage.

It is an aspect of the invention to provide that the inlet means includes a generally vertical portion defining the first passage portion and a transverse portion defining the second passage portion.

This expansion valve inlet strainer system is relatively easy and inexpensive to manufacture and install and can readily be removed and replaced.

BRIEF DESCRIPTION OF THE DRAWING

FIG. 1 is a longitudinal sectional view through an expansion valve having a conventional prior art inlet strainer;

FIG. 2 is an enlarged sectional view on-line 2—2 of the valve of FIG. 1;

FIG. 3 is a fragmentary sectional view through the improved expansion valve, and FIG. 4 is an enlarged sectional view taken on line 3—3 of the valve of FIG. 3.

FIG. 5 is a fragmentary sectional view through a modified improved expansion valve.

DESCRIPTION OF THE PREFERRED EMBODIMENT

Referring now by reference numerals to the drawing and first to FIGS. 1 and 2, it will be understood that there is shown an example of a prior art valve as manufactured by Sporlan Valve Company, the assignee of the valve herein, and shown in its Bulletin 10—10 dated October 1981 and entitled *Thermostatic Expansion Valves With Selective Charges* which is incorporated herein by reference. The expansion valve in question is shown on page 25 of the Bulletin and referred to as Type G.

The prior art Type G valve indicated by numeral 10, and shown in FIGS. 1 and 2, is identical to the valve 110 of the present invention shown in FIGS. 3 and 4 except for the inlet strainer assembly. Prior art valve 10 will be briefly described, it being understood that for the improved valve 110 parts not shown are identical to those shown for valve 10.

Expansion valve 10 includes a body 12 having an inlet fitting 14 receiving refrigerant from a refrigeration system (not shown), and an outlet fitting 16 returning refrigerant to the refrigerant system evaporator (not shown). The valve 10 is conventional in that it includes a valve means 20 consisting of a valve port 22 and a valve pin 24. The valve also includes an adjustable spring assembly 30 consisting of a spring retainer 32, a spring 34, a spring support 36 and an adjustment screw 38. A control assembly 40 is also provided consisting of a diaphragm 42 and a bulb line 44 attached to a point downstream of the evaporator (not shown).

In valve 10 the inlet fitting 14 includes a vertical portion 50, generally parallel to the valve body 12 and having an elongate passage 52, and an inclined transverse portion 54 having an inclined passage 56 communicating at one end with said vertical passage 52 and at the other end with the valve port 22. A conventional ball stop 53 is used as part of the manufacturing process and the vertical and transverse passages 152 and 156 intersect each other. The inlet fitting vertical portion 50 is adapted at its lower end 58 to connect to a flared fitting (not shown) and receive a strainer assembly 60. Vertical portion 50 is closed at the upper end 59.

The strainer assembly 60 includes a conical base portion 62, adapted to cooperate with the flared fitting, and base portion 62 is recessed to receive an elongate strainer tube 64 and opposed leaf springs 65, both connected as by soldering, by which the strainer assembly 60 is held when pushed into place. The tube 64 is provided with a soldered closure cap 66, which is substantially the same diameter as the portion of the base received within the passage 52 to provide a sliding fit within the passage 52. By this structural arrangement of parts, refrigerant is received within the strainer tube 64 and the tube removes dirt from the refrigerant before it enters the transverse passage 56, which communicates with elongate passage 52 between the ends of the strainer tube 64. The refrigerant is thereby cleaned before it enters the valve port 22.

As shown in FIGS. 3 and 4 the improved valve 110 includes a modified inlet fitting 114. The modified fitting 114 includes a vertical portion 150 spaced from the valve body 112 and having an elongate passage 152 and an inclined transverse portion 154 having a transverse passage 156 intersecting said vertical passage communicating at one end with said vertical passage 152, and at the other end with the valve port (not shown). The passage 152 is widened at its lower end 158 to receive a soldered connection 155 and the fitting 150 is distinguished from the prior art construction in that it is open at the upper end 159 and is threaded to receive a strainer assembly 160.

The strainer assembly 160 includes a closed outer end in the form of a threaded stud 162 adapted to be threadedly connected within the passage 152 and recessed to receive an elongate strainer tube 164. The tube 164 is provided with a closure ring 166 which has an outside diameter slightly less than the diameter of the passage 152 so that it is received in sliding, substantially sealed relation within said passage. The ring 166 is disposed below the entrance to the transverse passage 156 communicating with passage 152 between the ends of the strainer tube 164. By this structural arrangement of parts refrigerant is received within the strainer tube 164 and dirt is removed from the refrigerant by the inside of the strainer wall before it enters the transverse passage 156 leading to the valve port (not shown). Engagement of the underside of the head of the stud 162 in sealing relation with the margin of the passage end 159, automatically positions the strainer assembly 160 within the inlet passage 152 so that the tube extends across the transverse passage 156.

As will be readily understood the strainer assembly 160 is removed for cleaning by simply unthreading the stud 162 from the inlet fitting 150. The assembly 160 can be cleaned and replaced and the entire operation can be undertaken without disturbing the inlet connection to the expansion valve 110 in any way.

In the improved valve 110 shown in FIGS. 3 and 4, the strainer 160 is located in the vertical portion of the modified fitting 114. The strainer can also be located in the inclined transverse portion as will now be described by reference to FIG. 5.

As shown in FIG. 5 the improved valve 210 includes a modified inlet fitting 214 having a vertical portion 250 having an elongate passage 252 which is closed at the upper end 259, as in the prior art valve shown in FIG. 1. The inclined transverse passage 256, on the other hand, is threaded at the normally closed end 253 and is counterbored to a sufficiently large diameter for at least a portion of its length at the upper end, of the passage 256 to receive a strainer assembly 260, which can be essentially identical with the strainer assembly 160. By this structural arrangement of parts refrigerant is received within the strainer tube 264 but dirt is removed by the outside of the strainer wall before refrigerant enters the tube. The refrigerant, already cleaned, exits the strainer tube 264 by way of the closure ring 266, which is received in sliding, substantially sealed relation within passage 256, en route to the valve port (not shown). As with the embodiment described in FIGS. 3 and 4, engagement with the underside of the head of the stud 262 with the passage end 259 automatically positions the strainer assembly 260 within the passage 256 so that the strainer tube extends across vertical passage 252.

Although the improved expansion valve strainer assembly has been described by making particularized reference to a preferred valve mechanism, the details of description are not to be understood as restrictive, numerous variants being possible within the principles disclosed and within the fair scope of the claims hereunto appended. Moreover, although the strainer assembly has particular use with an expansion valve having soldered fittings it can be adapted for use with a valve having flared fittings which would also provide the advantage of leaving such fittings undisturbed during removal, cleaning and replacement of the strainer assembly.

We claim as our invention:

1. An inlet strainer assembly for an expansion valve of the type including an inlet means receiving refrigerant from a refrigerant system, an outlet means returning refrigerant to the system and a valve means disposed between said inlet and outlet means:

(a) the valve inlet means including first and second transversely related communicating passage portions, the first passage portion having a refrigerant-receiving inlet opening at one end, adapted to receive an inlet line in sweated or soldered relation, and having means at the other end providing a strainer-receiving opening disposed in axially aligned relation with said inlet opening, the second passage portion communicating with the valve means, and (b) a strainer means including a closed end and an open end and a strainer tube disposed between said ends, said closed end being threadedly connected to said strainer-receiving opening and said strainer tube being received within said first passage portion and extending across said second passage portion whereby refrigerant is received into said tube and strained prior to entering said second passage portion.

2. An inlet strainer assembly for an expansion valve of the type including an inlet means receiving refrigerant from a refrigerant system, an outlet means returning refrigerant to the system and a valve means disposed between said inlet and outlet means:

(a) the valve inlet means including first and second transversely related communicating passage portions, the first passage portion having a refrigerant-receiving inlet opening at one end, adapted to receive an inlet line in sweated or soldered relation, the second passage portion communicating with the valve means at one end, and having means at the other end providing a strainer-receiving opening, and (b) a strainer means including a closed end and an open end and a strainer tube wall disposed between said ends, said closed end being threadedly connected to said strainer-reeving opening and said strainer tube being received within said second passage portion and extending across said first passage portion whereby refrigerant is received into said tube through the strainer wall and strained prior to entering said second passage portion the strainer means including an end portion having a diameter to be received by said second passage portion on the other side of the first passage portion in sliding relation.

3. An inlet strainer assembly as defined in claim 2, in which:

(c) the second passage portion extends beyond the end of the strainer means.

* * * * *